US010610867B2

(12) United States Patent
Charreyre

(10) Patent No.: US 10,610,867 B2
(45) Date of Patent: Apr. 7, 2020

(54) DEVICE AND METHOD FOR OPENING CONTAINERS CONTAINING HETEROGENEOUS MATERIALS

(71) Applicant: Finance Developpement Environnement Charreyre—FIDEC, Polignac (FR)

(72) Inventor: Fabien Michel Alain Charreyre, Allegre (FR)

(73) Assignee: Finance Developpement Environnement Charreyre—FIDEC, Polignac (FR)

( * ) Notice: Subject to any disclaimer, the term of this patent is extended or adjusted under 35 U.S.C. 154(b) by 613 days.

(21) Appl. No.: 15/102,510

(22) PCT Filed: Dec. 10, 2014

(86) PCT No.: PCT/FR2014/053257
§ 371 (c)(1),
(2) Date: Jun. 7, 2016

(87) PCT Pub. No.: WO2015/086993
PCT Pub. Date: Jun. 18, 2015

(65) Prior Publication Data

US 2016/0376050 A1 Dec. 29, 2016

(30) Foreign Application Priority Data

Dec. 10, 2013 (FR) ..... 13 62377

(51) Int. Cl.
*B02C 2/00* (2006.01)
*B02C 2/10* (2006.01)
(Continued)

(52) U.S. Cl.
CPC ..... *B02C 2/00* (2013.01); *B02C 2/10* (2013.01); *B02C 18/0084* (2013.01);
(Continued)

(58) Field of Classification Search
CPC ..... B02C 2/00; B02C 2/10; B02C 18/0084; B02C 18/10; B65B 69/0008; B65B 69/0033; B65B 69/0058
(Continued)

(56) References Cited

U.S. PATENT DOCUMENTS 1,651,425 A * 12/1927 Wadleigh ..... B02C 2/10 241/259.1
4,905,919 A * 3/1990 Okazaki ..... B02C 18/0084 241/160
(Continued)

FOREIGN PATENT DOCUMENTS

CN 201565334 U * 9/2010 ..... B02C 18/06
DE 4400228 A1 7/1995
(Continued)

OTHER PUBLICATIONS

Chang, Translation of CN201565334U, 2010 (Year: 2010).*

*Primary Examiner* — Adam J Eiseman
*Assistant Examiner* — Bobby Yeonjin Kim
(74) *Attorney, Agent, or Firm* — John P. White; Cooper & Dunham LLP

(57) ABSTRACT

The invention relates to a device (1) for opening containers (C), the device comprising:

an enclosure (2) having an inlet (3) for admitting containers (C), the inlet being above an outlet (4);

a rotary shredder tool (10) suitable for causing the containers (C) to open, and extending between a bottom end (11) and a top end (12), said shredder tool (10) being mounted via its top end (12), the bottom end (11) of said shredder tool (10) being free inside said enclosure (2); and drive means (14) for driving rotation of said shredder tool (10);

(Continued)

the device (1) being characterized in that said shredder tool (10) presents a reference position from which it can move away while continuing to perform its function of opening the containers (C), said shredder tool (10) having a natural tendency to return to its reference position under the action of return means (34).

Opening containers.

4 Claims, 3 Drawing Sheets

(51) Int. Cl.

| | |
|---|---|
| ***B65B 69/00*** | (2006.01) |
| ***B02C 18/00*** | (2006.01) |
| ***B02C 18/10*** | (2006.01) |
| ***B65F 1/12*** | (2006.01) |

(52) U.S. Cl.
CPC ..... *B02C 18/10* (2013.01); *B65B 69/0008* (2013.01); *B65B 69/0033* (2013.01); *B65F 1/12* (2013.01)

(58) Field of Classification Search
USPC ..... 241/261.1, 259.1, 260, 97, 80
See application file for complete search history.

(56) References Cited

U.S. PATENT DOCUMENTS

| | | | | |
|---|---|---|---|---|
| 4,905,920 | A * | 3/1990 | Siwersson | B02C 15/02 241/207 |
| 5,762,463 | A * | 6/1998 | Bielagus | B65B 69/0008 241/186.35 |
| 2006/0024456 | A1* | 2/2006 | O'Leary | B02C 18/146 428/34.1 |
| 2008/0105597 | A1* | 5/2008 | Miller | B03B 9/06 209/1 |

FOREIGN PATENT DOCUMENTS

| | | | |
|---|---|---|---|
| EP | 0939035 | A1 | 9/1999 |
| JP | H0958641 | A | 3/1997 |
| SU | 937275 | A1 | 6/1982 |

* cited by examiner

DEVICE AND METHOD FOR OPENING CONTAINERS CONTAINING HETEROGENEOUS MATERIALS

CROSS-REFERENCE TO RELATED APPLICATIONS

This application is a § 371 national stage of PCT International Application No. PCT/FR2014/053257, filed Dec. 10, 2014, claiming priority of French Patent Application No. 1362377, filed Dec. 10, 2013, the content of each of which is hereby incorporated by reference into the application.

TECHNICAL FIELD

The present invention relates to the general technical field of reprocessing household refuse of any type, whether raw or residual, and in particular it relates to devices and methods for dispersing groupings of heterogeneous materials, of the household refuse kind, which groupings are initially contained in covers such as plastic bags.

The present invention relates more particularly to a device for opening containers containing heterogeneous materials of the household refuse kind in order to enable said materials to be released from the containers, said device comprising:

- an enclosure that is provided with an inlet for admitting containers and an outlet for released materials, the inlet being above the outlet;
- a shredder tool that is rotatably mounted about an axis of rotation within the enclosure, the shredder tool, while it is in rotation, being suitable for causing containers traveling through the enclosure to open when it comes into contact with said containers, said shredder tool extending along the axis of rotation between a bottom end and a top end of said shredder tool, said shredder tool being rotatably mounted on a guide support via its top end, the bottom end of said shredder tool being free inside said enclosure; and
- drive means for driving said shredder tool in rotation.

The present invention also relates to a method of opening containers containing heterogeneous materials of the household refuse kind in order to release said materials from the containers, the method comprising the following steps:

- introducing said containers into an enclosure having an inlet for admitting the containers and an outlet for the released materials, the inlet being above the outlet; and
- causing the containers traveling through the enclosure to be opened by putting them into contact with a shredder tool mounted to rotate about an axis of rotation within the enclosure, said shredder tool extending along the axis of rotation between a bottom end and a top end of said shredder tool, the tool being mounted to rotate on a guide support via its top end, the bottom end of said shredder tool being free inside said enclosure so as to leave a peripheral space for passing the containers around said shredder tool, the peripheral space forming a shredder channel through which the containers are caused to pass in order to be opened.

PRIOR ART

Prior art devices generally make use of a horizontal conveyor on which materials of household refuse type and including groupings of materials enclosed in bin bags made of plastics material or of paper, are transported for the purpose of the device opening or shredding said bags. For that purpose, like conventional garbage grinders, the device also makes use of a rotary horizontal cylinder arranged above the conveyor and having its axis of rotation perpendicular to the travel direction of said conveyor, the cylinder being designed to shred the bag when groupings of materials pass under the cylinder, e.g. with the help of shredder teeth, thereby releasing the materials that were initially contained in the bags.

Nevertheless, experience shows that such a device presents numerous drawbacks.

In particular, such devices are subjected to frequent failures, insofar as the materials put onto the belt are generally very heterogeneous in terms of shape, consistency, and mechanical strength. Certain materials transported by the conveyor towards the rotary cylinder strongly resist being ground (e.g. recycling articles such as discarded electrical appliances or bulky refuse), such that they cannot be ground with such a device, meaning that they are likely to damage said rotary cylinder or other components of the device, consequently leading to frequent stops and failures of the device. In particular, it is frequently observed that the rotary cylinder breaks or that the drive elements of said cylinder break, which elements are generally expensive to purchase and install, such that the expenses generated by maintaining that type of device are relatively high. Breaking parts of the device can also lead to a safety risk for people passing in the proximity of said device.

Furthermore, certain stringy materials with high breaking strength, e.g. video cassette tapes, foils, or plastics material fibers, can become wound around the rotary cylinder and its supports, thereby impeding its rotation, insofar as said rotary cylinder is generally rotatably mounted via its two ends on a stand of the device. In such a situation, the drive means for the rotary cylinder, generally in the form of an electric motor, can be caused to overheat or to be subjected to excessive force, thus constituting an additional source of failures. Likewise, stringy materials are likely to damage supports (in particular when they include ball bearings) e.g. by penetrating into the rotary assembly clearances that are needed to enable the rotary cylinder to rotate relative to the stand of the device.

Furthermore, certain materials can become wound around or can accumulate on the horizontal cylinder in such a manner as to cover its shredding teeth, which teeth are necessary for opening the bags. With its teeth covered in this way, the horizontal cylinder can no longer open the bags, and thus requires a cleaning operation (which usually requires the device to be stopped for a certain length of time), and that naturally represents a substantial loss of time.

Furthermore, the materials themselves, or at least those that present a considerable size given the travel space provided for the materials between the rotary cylinder and the conveyor, are frequently ground by the rotary cylinder as they go past. Consequently, the operation of the device can prevent certain materials being reused or recycled that might otherwise have been put to good use in this way, insofar as said materials are destroyed by the device and can become unusable.

Conversely, such a device appears to be incapable of opening bags that are of size that is too small relative to the space of fixed dimension through which they pass and that is provided between the cylinder and the conveyor. The distance between the cylinder and the conveyor is generally selected so as to limit the damage to the cylinder that can be caused by passing materials of large size, and to limit the grinding of such materials by the device, such that materials enclosed in packages of smaller sizes can go past the rotary cylinder without being touched thereby, i.e. without being opened. Thus, such a device presents the major drawback of leaving a frequently non-negligible quantity of bags unopened and not shredded.

The use of such a device can thus require an additional operation of previously sorting the bags of material that are to be opened by said device, which represents a substantial loss of time.

Another known device comprises a vertical enclosure having therein a shredder tool that is set into rotation about a vertical axis, the bags of material traveling downwards. The shredder tool is provided with a deflector cone at its top portion and lateral cutter blades in its bottom portion so that the bags of material coming into contact with said shredder tool are thrown against the inside wall of the enclosure under the effect of centrifugal force, and are cut open by the blades of said shredder tool.

Nevertheless, that device does not appear to be capable of solving the above-mentioned problems, insofar as certain materials of large size or of great strength relative to the dimensioning of the device continue to run the risk of damaging the shredder tool or of being ground to some extent thereby. Conversely, bags of small size can pass through the device without coming into contact with the tool and thus without being opened, as in the above-mentioned device with a horizontal rotary cylinder. Furthermore, filamentary materials can become wound around the shredder tool and can impede its rotation, insofar as it is rotatably mounted on a horizontal arm secured to the enclosure, which arm is placed between the top end and the bottom end of the shredder tool.

Finally, it appears that none of the known devices is capable of mitigating the above-mentioned drawbacks.

SUMMARY OF THE INVENTION

The objects given to the invention consequently seek to propose a novel device and a novel method for opening containers and that are capable of remedying those drawbacks, in particular by enabling containers having a very heterogeneous range of strengths and dimensions to be opened effectively.

Another object of the invention is to propose a novel device and a novel method for opening containers, and making it possible to treat containers and materials of large size.

Another object of the invention is to propose a novel device and a novel method for opening containers, and that operate reliably and safely.

Another object of the invention is to propose a novel device and a novel method for opening containers, and presenting operating, upkeep, maintenance, and repair costs that are relatively low.

Another object of the invention is to propose a novel device and a novel method for opening containers, and of design that is simple and robust.

Another object of the invention is to propose a novel device and a novel method for opening containers, and presenting high efficiency, in particular making it possible to open containers effectively, even when they are of small size.

Another object of the invention is to propose a novel opening device and method making it possible to reduce risks of the device jamming or being damaged as a result of the presence of filamentary elements in the containers.

Another object of the invention is to propose a novel device and a novel method for opening containers, and having low energy consumption.

Another object of the invention is to propose a novel device and a novel method for opening containers, and adapted to an industrial context of opening containers.

The objects assigned to the invention are achieved with a device for opening containers containing heterogeneous materials of the household refuse kind in order to enable said materials to be released from the containers, said device comprising:

an enclosure that is provided with an inlet for admitting containers and an outlet for released materials, the inlet being above the outlet;

a shredder tool that is rotatably mounted about an axis of rotation within the enclosure, the shredder tool, while it is in rotation, being suitable for causing containers traveling through the enclosure to open when it comes into contact with said containers, said shredder tool extending along the axis of rotation between a bottom end and a top end of said shredder tool, said shredder tool being rotatably mounted on a guide support via its top end, the bottom end of said shredder tool being free inside said enclosure; and drive means for driving said shredder tool in rotation;

the device being characterized in that said shredder tool presents a reference position that it occupies naturally in the absence of containers in the enclosure, said shredder tool being suitable for moving away from its reference position when containers pass through said enclosure while it continues to perform its function of opening containers passing through said enclosure, said shredder tool tending naturally to return to its reference position under the action of return means.

The objects assigned to the invention are also achieved with the help of a method of opening containers containing heterogeneous materials of the household refuse kind in order to release said materials from the containers, the method comprising the following steps:

introducing said containers into an enclosure having an inlet for admitting the containers and an outlet for the released materials, the inlet being above the outlet; and causing the containers traveling through the enclosure to be opened by putting them into contact with a shredder tool mounted to rotate about an axis of rotation within the enclosure, said shredder tool extending along the axis of rotation between a bottom end and a top end of said shredder tool, the tool being mounted to rotate on a guide support via its top end, the bottom end of said shredder tool being free inside said enclosure so as to leave a peripheral space for passing the containers around said shredder tool, the peripheral space forming a shredder channel through which the containers are caused to pass in order to be opened;

the method being characterized in that it includes a step during which the size of said shredder channel adjusts itself as a function of the containers passing through it.

BRIEF SUMMARY OF THE DRAWINGS

Other features and advantages of the invention appear and can be seen in greater detail on reading the following description made with reference to the accompanying drawings, which are given purely by way of non-limiting illustrative example, and in which.

BEST MANNER OF EMBODYING THE INVENTION

Figure 2:
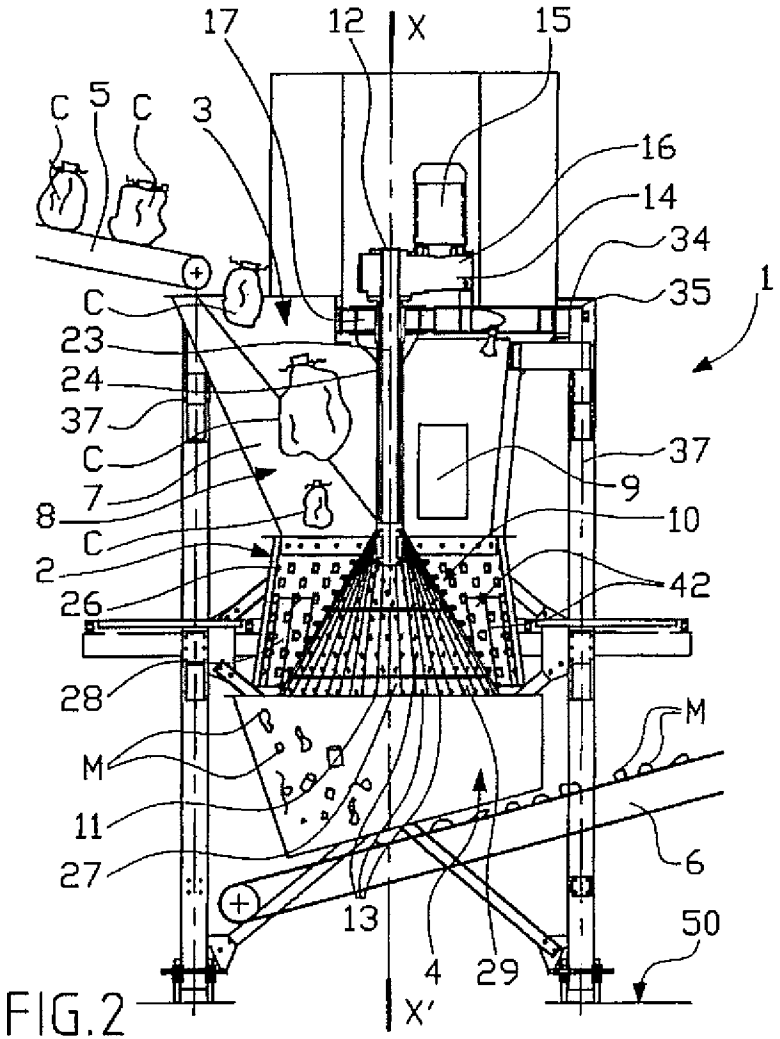
FIG. 2 is an overall side view, partially in longitudinal section, showing the container-opening device of FIG. 1.

In a first aspect, the invention relates to a device 1 for opening containers C containing heterogeneous materials M, of the household refuse kind, in order to enable said materials M to be released from the containers C.

In the invention, the containers C are closed or semi-closed covers suitable for containing the materials M. Each container C thus forms a pouch, a bag, or a net within which the materials M are enclosed. Without going beyond the ambit of the invention, the containers C could equally well be in the form of boxes, bins, cages, or packages of any type, providing they are suitable for containing said materials M. In any event, the containers C may be opened in accordance with the invention by being shredded, by abrasion, or by piercing so as to create at least one opening through which the materials M can escape from said containers C. In this sense, the containers C are both sufficiently flimsy and fragile to be opened by the device 1 or by a user (e.g. using a knife or opening with their hands), and sufficiently strong to contain the materials M. The containers C preferably present less resistance to shredding or piercing than do the materials M that they contain.

The device 1 is preferably designed to process containers C in the form of a cover made of material that is flexible and/or designed to be torn, shredded, or pierced. The containers C are preferably bags made of paper or of plastics material, of the bin bag type, and they are closed or wrapped beforehand by users.

In the invention, the device 1 is designed to open the containers C containing materials M of very great heterogeneity and thus constituting heterogeneous materials M, the "materials" in the meaning of the invention comprising a multitude of articles of a variety of natures and origins, being liquids, solids, or even gases, and of shapes, substances, structures, sizes, weights, and mechanical properties that are diverse and unpredictable. In particular, certain materials M contained in the containers C may be suitable for mechanical grinding, and for this purpose they present appropriate mechanical properties, e.g. such as a degree of fragility and/or little toughness, and/or size that is sufficiently small. Certain other materials M also contained in the containers C may, on the contrary, be found to be stronger, and in particular to withstanding grinding, and they may be likely to damage a conventional grinder machine, such as a garbage grinder machine, by jamming it. In the invention, certain materials M and certain containers C may equally well be of a fibrous or filamentary nature, e.g. comprising strings, magnetic tapes, cables, or indeed bin bag closure ties, any of which can tangle together or become wound or wrapped around rotary elements.

The materials M are preferably waste, and/or household refuse that is to be subjected to waste or recycling treatment, and that has been enclosed in the containers C by users (e.g. households, businesses, factory employees) who consider them as waste and/or as materials M that they cannot make use of personally and that are to be transformed.

In the meaning of the invention, the household refuse contained in the containers comprises raw household refuse, i.e. refuse that has not been subjected to any treatment or sorting prior to being bagged, or residual household refuse, that has been subjected to prior but rough) sorting, e.g. by separating out paper and/or card, and various elements made of plastics materials or of metals, from the remainder of the initial mass of household refuse or waste.

Figure 1:
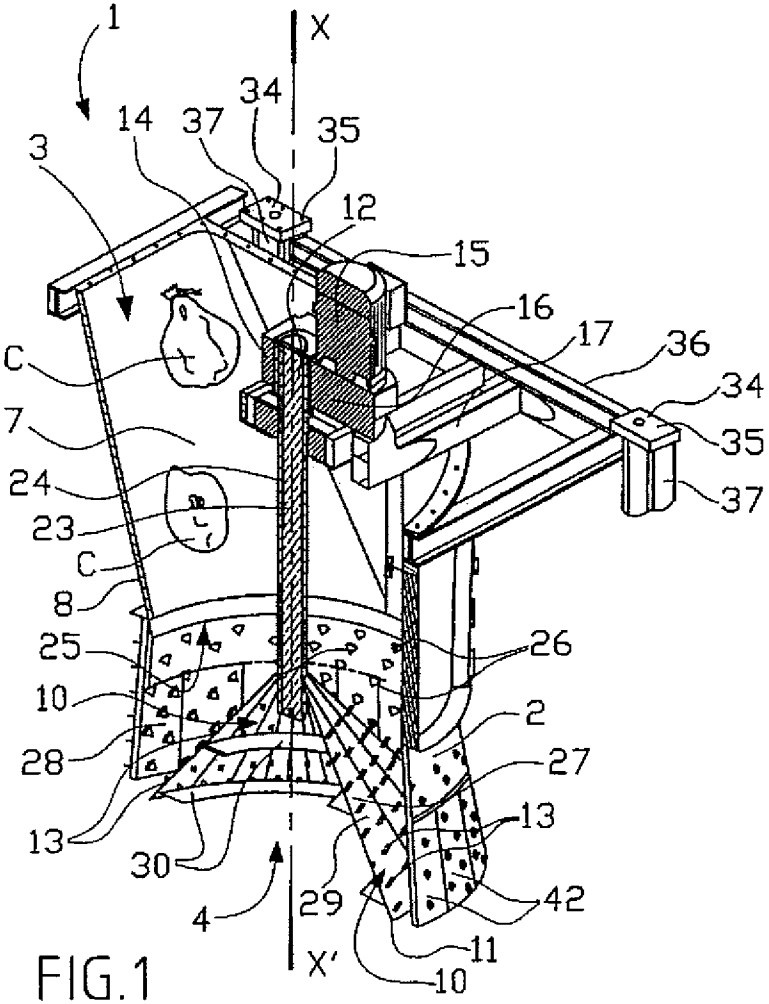
FIG. 1 is an overall view in perspective and in longitudinal section showing a container-opening device in accordance with the invention.

The device 1 of the invention may be in the form of a household refuse bag opener, as shown in FIGS. 1 and 2, and it is designed for use on an industrial scale. The device 1 should preferably be used within a waste reprocessing factory, or a factory for opening containers C on a large scale.

In the invention, the device 1 comprises an enclosure 2 that is provided with an inlet 3 for admitting containers C and an outlet 4 for released materials M, the inlet 3 being above the outlet 4.

In the invention, the enclosure 2 forms the shell of the device 1, within which the containers C are to be opened and the materials M are to be released from the containers C. By way of example, the enclosure 2 comprises for this purpose a side wall 8 connecting the inlet 3 to the outlet 4, said side wall 8 enabling the containers C and the materials M to be guided through the enclosure 2 from the inlet 3 towards the outlet 4. By way of example, the side wall 8 forms a tunnel.

The device 1 in accordance with the invention as shown in FIGS. 1 and 2 presents a vertical enclosure 2 with its inlet 3 at the top, which inlet is served by an inlet conveyor 5, and it has its outlet 4 in its bottom portion, which outlet 4 is served by an outlet conveyer 6. The inlet conveyor 5 is designed to convey full containers C to the inlet 4, the outlet conveyor 6 being designed to discharge the materials M released from their containers C, together with the remains of the open containers C. The enclosure 2 shown in FIGS. 1 and 2, is formed in its upper portion by a hopper 7 for guiding the containers C, which hopper extends from the inlet 3, and the enclosure is formed in its bottom portion by a zone for opening the containers C, which zone extends between the hopper 7 and the outlet 4. The hopper 7 shown in FIGS. 1 and 2 has an inspection hatch 9 through which a user can penetrate in full or in part into the enclosure 2 of the device 1, e.g. in order to perform maintenance or cleaning operations inside said device 1.

In the invention, the inlet 3 is placed above the outlet 4 so that the containers C and the materials M can progress through the enclosure from the inlet 3 towards the outlet 4 in a downward direction, in particular with the help of gravity. The shape of the enclosure 2, and in particular of its side wall 8, and the arrangement of the inlet 3 facing the outlet 4, enables the containers C and the materials M to drop within the enclosure 2.

In the invention, the containers C containing the materials M, possibly in association with or mixed with released materials M that are not contained in containers C, are to be inserted into the device 1 via the inlet 3, preferably in such a manner as to feed the device 1 substantially continuously or with batches of containers C, in order to enable the containers C to be opened at an industrial rate.

In the invention, the device 1 includes a shredder tool 10 that is mounted to rotate about an axis of rotation within the enclosure 2, the shredder tool 10 being suitable for opening the containers C passing through the enclosure 2 when it is set into rotation and when it comes into contact with said containers C, said shredder tool 10 extending along the axis of rotation X-X' between a bottom end 11 and a top end 12 of said shredder tool 10.

In the invention, the shredder tool 10 is designed to rotate about its longitudinal axis forming the axis of rotation X-X', and it preferably presents weight that is balanced around said axis of rotation X-X' connecting the top end 12 to the bottom end 11. In the invention, the shredder tool 10 is oriented in such a manner that the top end 12 is at a height that is greater than the height of the bottom end 11. The axis of rotation X-X' is preferably oriented in the alignment of the enclosure 2 and in particular of its side wall 8, or else in the alignment of the downward travel direction of the containers C. In preferred manner, the axis of rotation X-X' is substantially vertical, as shown in FIGS. 1, 2, 4, and 5. The device 1 in accordance with the invention and as shown in FIGS. 1 and 2 has a shredder tool 10 with its top end 12 situated in the vicinity of the inlet 3, and with its bottom end situated in the vicinity of the outlet 4.

In the invention, the shredder tool 10 may be included entirely inside the enclosure 2, or it may present a bottom end 11 and/or a top end 12 projecting respectively from the bottom and/or the top of the enclosure 2, e.g. through the outlet 4 and/or through the inlet 3.

In the invention, the shredder tool 10 may be in the form of a rotary cutting machine, a milling cutter, or a grinder, and it is designed to cut, slice, tear, rip open or pierce the containers C so that they release the materials M they contain. The shredder tool 10 of the invention may also be designed to throw the containers C against the side wall 8 inside the enclosure 2 by making use of the centrifugal force generated by the rotation of said shredder tool 10, so that the impacts of the containers C against the wall leads to said containers C being opened. The shredder tool 10 shown in FIGS. 1, 2, 4, and 5 is designed both to shred the containers C and to throw them against the side wall 8 of the enclosure 2 so as to cause them to be opened in order to extract their contents.

In the invention, the device 1 has drive means 14 for driving said shredder tool 10 in rotation. The drive means 14 serve to rotate the shredder tool 10 by delivering sufficient torque to said shredder tool 10 to enable it to rotate and cause the containers C to be opened. The drive means 14 may be embodied by any known means, and for example they may comprise a motor 15 (e.g. an electric motor) and gearing 16 via which the motor 15 drives the shredder tool 10, as shown in FIGS. 1, 2, 4, and 5.

In the invention, the shredder tool 10 is mounted to rotate on a guide support 17 via its top end 12, the bottom end 11 of said shredder tool 10 being free inside said enclosure 2. Thus, in the invention, the shredder tool 10 projects from the guide support 17 in such a manner as to extend within the enclosure 2 by projecting from said guide support 17 over at least a majority of its length, and being directed towards the ground 50. This configuration thus enables the bottom portion of the shredder tool 10 to be disengaged, in particular around its bottom end 11. Specifically, a completely free zone is arranged around the shredder tool 10. The containers C can thus come into contact with all of the bottom portion of said shredder tool 10.

The guide support 17 is designed to support the shredder tool 10 from the top, being arranged above it, such that said shredder tool 10 is suspended from said guide support 17. The guide support contains both a rotary connection in which the shredder tool 10 is free to rotate about its axis of rotation X-X', and an axial abutment enabling the guide support 17 to support said guide tool 17 without impeding its rotation. Thus, the shredder tool 10, and in particular the axis of rotation X-X' of the shredder tool 10, projects downwards from the guide support 17, said shredder tool 10 being in a "head-down" orientation.

Preferably, the shredder tool 10 bears solely against the guide support 17, and it is not mechanically connected to any other support, apart from the drive means 14.

In the invention, the shredder tool 10 presents a bottom end 11 that is free, i.e. that is situated at a distance from any other portion of the device 1, and in particular of the enclosure 2, so that the containers C can pass without obstruction (other than from the shredder tool 10 itself) through the space left between said shredder tool 10 and the side wall 8 of said enclosure 2. In this way, an empty space for passing the containers C is arranged at the periphery of the shredder tool 10, which is suspended like a pendulum in the core of the enclosure 2.

Advantageously, such a design serves in particular to limit the winding and wrapping around the shredder tool 10 of stringy or filamentary elements that might be presented by the containers C or the materials M, such that said shredder tool 10 advantageously presents little tendency to being braked in its rotation by stringy or filamentary elements. If stringy or filamentary elements do indeed accumulate on the shredder tool 10, such a design also makes it possible to clean the tool by causing said accumulated elements to pass via the bottom end 11 of said shredder tool 10 since it is free, thus making it easy for said elements to be separated from said shredder tool 10. Such cleaning may advantageously be performed when the device 1 is stopped, e.g. by acting via the inspection hatch 9, as shown in FIG. 2. Furthermore, when the device 1 is in operation, the impacts of the containers C against the shredder tool 10 already serve, at least in part, to detach any residues of materials M that might accumulate on said shredder tool 10, such that the device 1 is self-cleaning.

In preferred manner, the shredder tool 10 has a drive shaft 23 extending from the top end 12 of said shredder tool 10 and driven in rotation by the drive means 14, as shown in FIGS. 1, 2, 4, and 5. The shredder tool 10 is suspended from the guide support 17 by the drive shaft 23, which is also designed to receive and transmit the rotary torque delivered by the drive means 14 to said shredder tool 10. The drive shaft 23 preferably lies on the axis of rotation X-X' of the shredder tool 10. The top end 12 of the shredder tool 10 advantageously coincides with the top end of the drive shaft 23.

Figure 4:
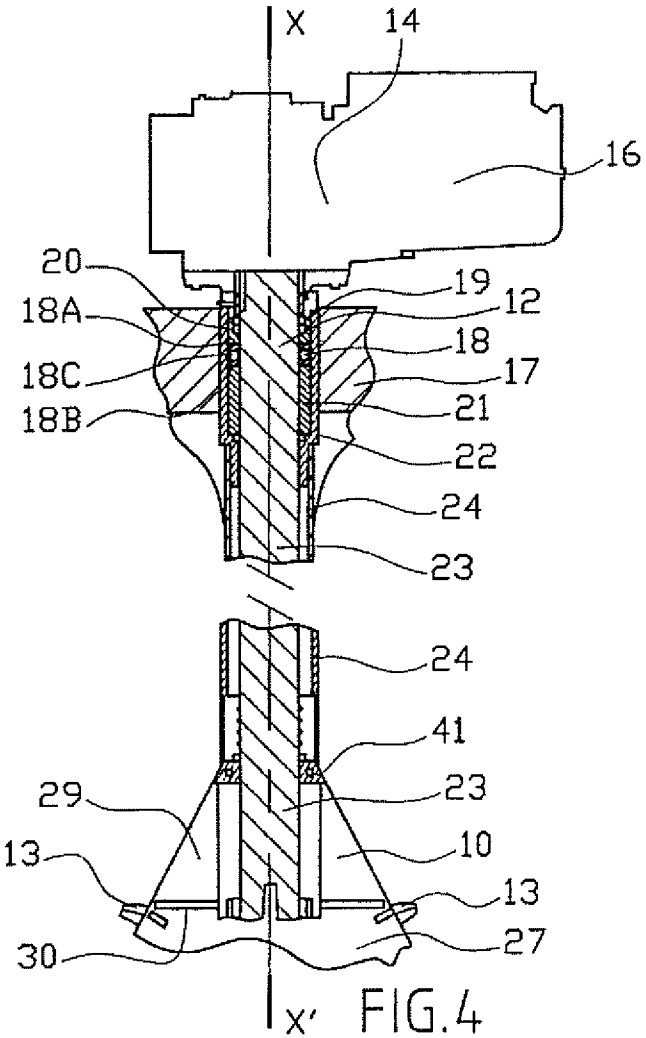
FIG. 4 is a side view in longitudinal section showing an embodiment detail of the FIG. 1 container-opening device, in particular a shredding tool of said FIG. 1 device and its drive means.

As shown in FIG. 4, the guide support 17 is advantageously provided with an axial thrust ball bearing 18 having a movable portion 18A, a stationary portion 18B, and balls 18C between the top movable portion 18A and the bottom stationary portion 18B, so as to facilitate rotation between them. The shredder tool 10 is suspended from the movable portion 18A via at least one notched nut 19 secured to the top end 12 of said shredder tool 10 (and in particular screwed onto a thread on the drive shaft 23), and forming a support shoulder for said shredder tool 10, said at least one notched nut 19 bearing against said movable portion 18A so as to rest on said movable portion 18A, e.g. via a top spacer 20 of appropriate size. As shown in FIG. 4, the stationary portion 18B rests on the guide support 17 via a bottom spacer 21 resting on an inside shoulder of a jacket 22 secured to said guide support 17.

Naturally, it is possible to envisage using any other rotary mount known in the art for mounting the shredder tool 10 on the guide support 17 without going beyond the ambit of the invention, providing the shredder tool 10 is mounted to rotate and is supported by the guide support 17 via the top end 12 of said shredder tool 10. By way of example, the rotary mount may comprise a journal bearing, a ball or roller bearing, etc. Likewise, where necessary, the rotary mount may be sealed using sealing means (such as gaskets) for protecting the rotary mount from potential projections of materials M or containers C that have been opened in the enclosure, or indeed projections of moisture.

The enclosure 2 preferably includes a shredder inside wall 25 surrounding the shredder tool 10 at a distance so as to leave a preferably annular shredder channel around said shredder tool 10, the containers C being caused to pass through the shredder channel in order to be opened. The empty space for movement arranged at the periphery of the shredder tool 10 is thus preferably encircled by the shredder wall 25, which forms part of the side wall 8 of the enclosure 2, and against which the containers C are to be thrown by said shredder tool 10 in order to cause them to be opened. The containers C can also be opened by friction when they are of sufficient size to come into contact simultaneously with the shredder wall 25 and with the shredder tool 10, so as to be stressed between them. In order to cause the containers C to be opened by friction, the shredder tool 10 and/or the shredder wall 25 are designed to retain the containers C individually by grip. To this end, the enclosure 2 advantageously includes a plurality of friction-backing teeth 26 within it, which teeth are designed to contribute to opening the containers C, said friction-backing teeth 26 being arranged helically on the inside periphery of said enclosure 2. Advantageously, the friction-backing teeth 26 are secured in particular to the shredder wall 25 and they are oriented centripetally. The friction-backing teeth 26 are arranged to catch and/or tear the containers C so as to open them, and for this purpose they are arranged in concentric spirals of friction-backing teeth 26, the spirals preferably being coaxial about the axis of rotation X-X' of the shredder tool 10. The containers C are preferably thrown against the friction-backing teeth 26 by the shredder tool 10 at a speed that is high enough for said friction-backing teeth 26 to open said containers C.

The shredder wall 10 is advantageously designed to be sufficiently extensible and resilient to be capable of extending so as to increase (or reduce) the through section for the containers C, i.e. the size of the shredder channel, with this being as a function of said containers C passing through the shredder channel. Thus, containers C of large size, or of considerable strength, may for example deform the shredder wall 10 so as to increase the size of the shredder channel, thereby significantly lowering the risk of the device 1 being jammed by this type of container C. Once the container C has gone through, the shredder wall 10 advantageously returns to its initial shape, so as to reestablish the initial through section of the shredder channel.

By way of example, the shredder wall 10 may be made to be deformable with the help of pivotal flaps 42 as described below.

Advantageously, the enclosure 2 is divided into two portions:

- a top portion into which containers are admitted and through which they drop, the top portion extending from the inlet 3 and preferably being formed by the hopper 7; and
- a bottom portion that is defined by the shredder wall 25.

In complementary manner to the friction-backing teeth 26, the shredder tool 10 preferably includes a plurality of shredder knives 13 arranged helically at the periphery of said shredder tool 10 and oriented centrifugally, as shown in FIGS. 1, 2, 4, and 5, said knives 13 being designed to catch, pierce, and rip open the containers C when they come into contact therewith, just like the friction-backing teeth 26. The rotation of the shredder tool 10 in combination with the travel speed of the containers C through the enclosure 2 preferably enables said blades 13 to reach the containers C at a speed that is sufficient to cause them to open. The blades 13 are preferably also designed to contribute to throwing the containers C against the side wall 8 of the enclosure 2, and in particular against the friction-backing teeth 26 of the shredder wall 25, and for this purpose they are arranged in such a manner as to form series of knives 13 in concentric spirals about the axis of rotation X-X' of the tool. The knives 13 and the friction-backing teeth 26 are each individually in the form of a blade, a spike, or a fin projecting respectively from the shredder tool and from the shredder wall 25.

Preferably, the shredder tool 10 has a first shredder module 27 extending over a fraction of the axis of rotation X-X' of said shredder tool 10 and of cross-section that increases in the flow direction of the containers C. Preferably, and as shown in FIGS. 1, 2, 4, and 5, the first shredder module 27 extends between the bottom end of the drive shaft 23 and the bottom end of the shredder tool 10. The first shredder module 27 preferably forms an upside-down funnel having knives 13 at its periphery. Such an arrangement enables the containers C, as they fall under gravity through the enclosure 2, to come into contact with the first shredder module 27 and to bounce off it towards the shredder wall 25.

In preferred manner, and as shown in FIGS. 1, 2, 4, and 5, the shredder tool 10, and in particular the first shredder module 27, forms a first cone 29 that is coaxial about the axis of rotation X-X' of said shredder tool 10 and that has its apex pointing towards the top end 12 of said shredder tool 10, the first cone 29 bristling with knives 13 that project outwards from said first cone 29. The first cone 29 is preferably secured at its apex to the bottom end of the drive shaft 23, and is formed by a plurality of plates extending radially from said drive shaft 23, the plates being connected to one another by concentric internal rings 30 providing said first cone 29 with structural strength, the inside of said first cone 29 being hollow and consequently advantageously being lightweight. Such an arrangement enables the containers C, on dropping under gravity through the enclosure 2, to come into contact with the first cone 29 and to bounce off it towards the shredder wall 25.

The shredder wall 25 preferably forms a first friction-backing stage 28 of cross-section that increases in the travel direction of the containers C, and surrounding the first shredder module 27 of the shredder tool 10 so as to contribute to forming the shredder channel that presents an annular section of area that decreases in the travel direction of the containers C. In this way, the peripheral annular space around the shredder tool 10 forms a converging annular channel. Thus, the containers C containing the materials M, most of which containers are much larger in volume than the materials M that they contain, can slide in the preferably annular shredder channel between the shredder tool 10 and the shredder wall 25. The containers C then encounter a constriction of the shredder channel, such that it is necessary for a container C to be opened in order to enable it to pass through said shredder channel in the form of materials M that have been released and that are smaller in size than said container C. In this way, a maximum percentage of the containers C introduced into the enclosure are opened.

Preferably, and as shown in FIGS. 1, 2, 4, and 5, the enclosure 2, and in particular the first friction-backing stage 28, forms a frustoconical skirt that is substantially coaxial with the first cone 29 and of cone angle that is more acute than the cone angle of said first cone 29, so as to form a converging annular shredder channel.

Figure 5:
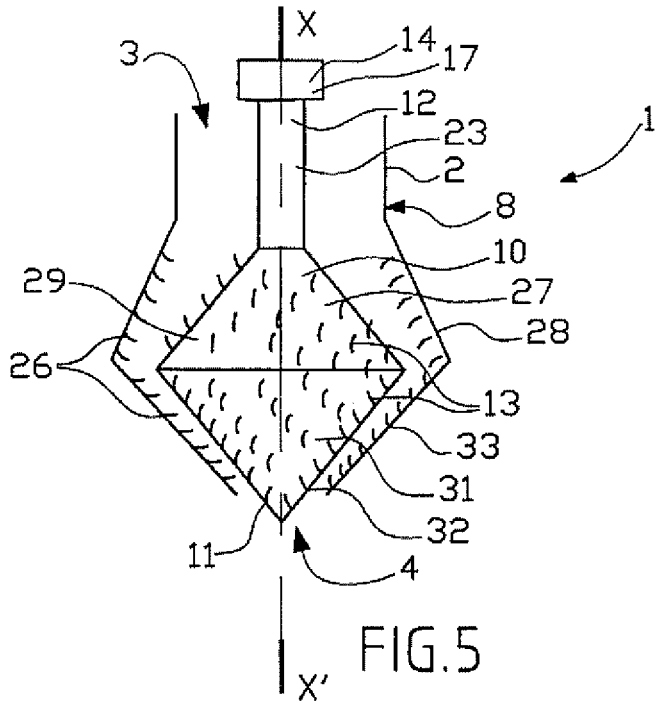
FIG. 5 is a diagrammatic side view in longitudinal section showing a variant of the device of the invention including a shredding tool forming first and second cones.

Preferably, and as shown in FIG. 5, said shredder tool 10 has a second shredder module 31 extending between the first shredder module 27 and the bottom end 11 of said shredder tool 10, and of cross-section that decreases in the travel direction of the containers C, the shredder wall 25 forming a second friction-backing stage 33 of cross-section that decreases in the travel direction of the containers C, and surrounding the second shredder module 31 of the shredder tool 10 so as to contribute to forming the shredder channel. The second friction-backing stage 33 associated with the second shredder module 31 extends the converging annular shredder channel, the shredder tool 10 forming a shredder cutter that is surrounded at a distance by the side wall 8 of the enclosure, such that the outlet 4 is circular in shape.

The shredder tool 10 and in particular the second shredder module 31, preferably forms a second cone 32 coaxial about the axis of rotation X-X' of said shredder tool 10 and having its apex pointing towards the bottom end 11 of said shredder tool 10, the base of the first cone 29 and the base of the second cone 32 coinciding, as shown in FIG. 5. The second cone 32 preferably bristles with knives 13 in the same manner as the first cone 29.

The enclosure 2, and in particular the second friction-backing stage 33 preferably forms an upside-down frustoconical skirt that is substantially coaxial about the second cone 32, and of cone angle that is less acute than the cone angle of said second cone 32 so as to extend the converging annular shredder channel formed by the association between the first cone 29 and the frustoconical skirt formed by the first friction-backing stage 28. The bottom edge of the frustoconical skirt formed by the first friction-backing stage 28 is preferably attached to the top edge of the upside-down frustoconical skirt formed by the second friction-backing stage 33, as shown in FIG. 5. The second friction-backing stage 33 preferably bristles with friction-backing teeth 26, like the first friction-backing stage 28.

In preferred manner, the shredder tool 10 has a stationary protective sheath 24 longitudinally surrounding the drive shaft 23 of the shredder tool 10 over at least the majority of the length of said drive shaft 23. The protective sheath 24 is preferably in the form of a cylindrical shell receiving the drive shaft 23 therein, e.g. surrounding it, the protective sheath 24 being secured by way of example to the guide support 17 in such a manner that it does not rotate, while enabling the drive shaft 23 to rotate within it. The presence of the non-rotary protective sheath 24 advantageously serves to limit stringy or filamentary elements coming from the containers C and the materials M passing through the enclosure 2 becoming wound around the drive shaft 23 and the shredder tool 10. The protective sheath 24 is preferably secured to the guide support 17 at its top end (as shown in particular in FIG. 4), and in particular is attached to the jacket 22 so as to project from said guide support 17.

The shredder tool 10 preferably presents a reference position in which it naturally places itself in the absence of containers C inside the enclosure 2, said shredder tool 10 being capable of moving away from its reference position while containers C are passing through said enclosure 2, while continuing to perform its function of opening containers C traveling through said enclosure 2, said tool having a natural tendency to return to its reference position under the action of return means 34. This technical characteristic of the device 1 could constitute the subject matter of an invention on its own that is not necessarily associated with the shredder tool 10 being mounted on the guide support 17 via its top end 12.

In the absence of any external mechanical stresses, as can be generated by the passage of containers C in contact with said shredder tool 10, the shredder tool 10 positions itself in stable equilibrium in its reference position, which is its default working position. When it is stressed by the containers C, the shredder tool 10 can move away a little from its initial position, in particular when containers C of large size or of considerable strength come into contact therewith. Once it has moved, the shredder tool 10 is designed to return automatically and immediately to its reference position under the action of the return means.

Such a design advantageously enables the passage of large or strong containers C to be damped, thus enabling the device 1 to treat a particularly heterogeneous range of containers. The shredder tool 10 is designed to move, which can prevent it being damaged, or might lead to its drive shaft 23 breaking, with the large and irregular forces that it needs to deliver being damped and taken up by the return means 34. The possibility of the shredder tool 10 moving, i.e. shifting, advantageously enables the through section available for the containers C to be varied. In particular, the shape of the shredder channel can thus change automatically in order to avoid substantially any jamming of the device 1, e.g. by local or general variation in its shape.

Since the device 1 is preferably designed so that the bottom end 11 of the shredder tool 10 is free and not attached to the enclosure 2, as described above, and since the shredder tool 10 is preferably mounted to be capable of moving automatically under the action of large containers, as described above, the risks of the device jamming and the risks of the shredder tool 10 becoming entangled are particularly low.

Finally, it is preferably the way the shredder tool 10 is mounted within the device 1, and in particular within the enclosure 2, that makes it possible to treat a very heterogeneous range of containers C in effective manner with limited risk of jamming and little maintenance.

The shredder tool 10 is shown in FIGS. 1, 2, 4, and 5 in its reference position, in which its axis of rotation X-X' is centered and substantially vertical inside the enclosure 2 (preferably the first cone 29 is coaxial with the first friction-backing stage 28). The shredder tool 10 is preferably capable of departing from its reference position by moving in translation along at least one axis perpendicular to the axis of rotation X-X', or at least in a plane normal to the axis of rotation X-X'. In alternative manner or in addition, the shredder tool may be capable of performing swinging or pendulum movements, e.g. about its top end 12.

The shredder tool 10 is preferably designed to depart from its reference position while continuing to rotate in the event of receiving a container C or material that has been inserted into the enclosure 2 and that is of a size greater than the space arranged between the shredder tool 10 and the side wall 8 of the enclosure 2, or that is of strength that is too great to be opened, broken, or ground by said shredder tool 10, such a container C or material being referred to below as a "jamming element". On departing from its reference position, the shredder tool 10 thus leaves available to the jamming element substantially all of the space needed to allow said jamming element to pass through and be discharged to the outlet 4. Such a design thus makes it possible to avoid the device 1 being jammed by jamming elements, e.g. of a kind that might otherwise block and/or damage said device 1, in particular when said jamming element is bulky refuse or a recycling center article that withstands grinding.

The return means 34 are designed so that in the absence of jamming material in the enclosure 2, the shredder tool 10 remains substantially in its reference position, and so that any jamming element that might block the device 1 causes said shredder tool 10 to move away from its reference position automatically. The jamming element itself preferably moves the shredder tool 10 away from its reference position, pushing it mechanically under the combined actions of gravity and of said shredder tool 10 rotating, acting against the return means 34. Naturally, a system for detecting jamming of the device 1 may also be installed, which system causes the shredder tool 10 to be moved away from its reference position, e.g. by using a shift actuator.

The guide support 17 of the shredder tool 10 is preferably secured to the enclosure 2 via at least one flexible connection 35 forming the return means 34, said guide support 17 forming a pivot connection with said shredder tool 10.

Thus, in this configuration, the guide support 17 and the shredder tool 10 are caused to be moved away from the reference position together, and they are secured to each other, ignoring rotation of said shredder tool 10.

Figure 3:
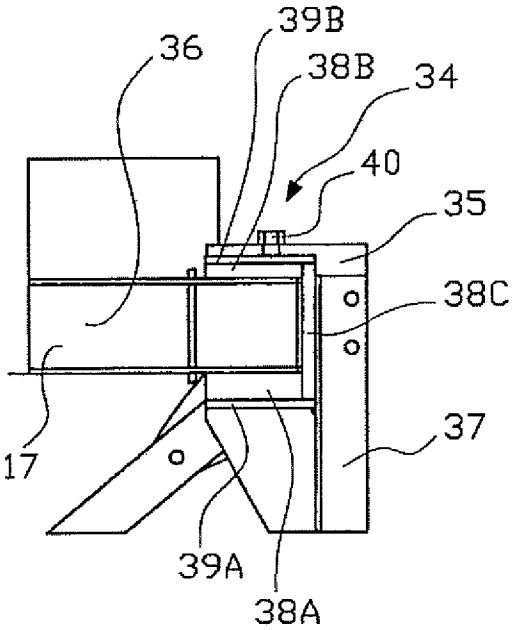
FIG. 3 is a side view showing an embodiment detail of the FIG. 1 device, in particular return means for a guide support of said FIG. 1 device.
Figure 6:
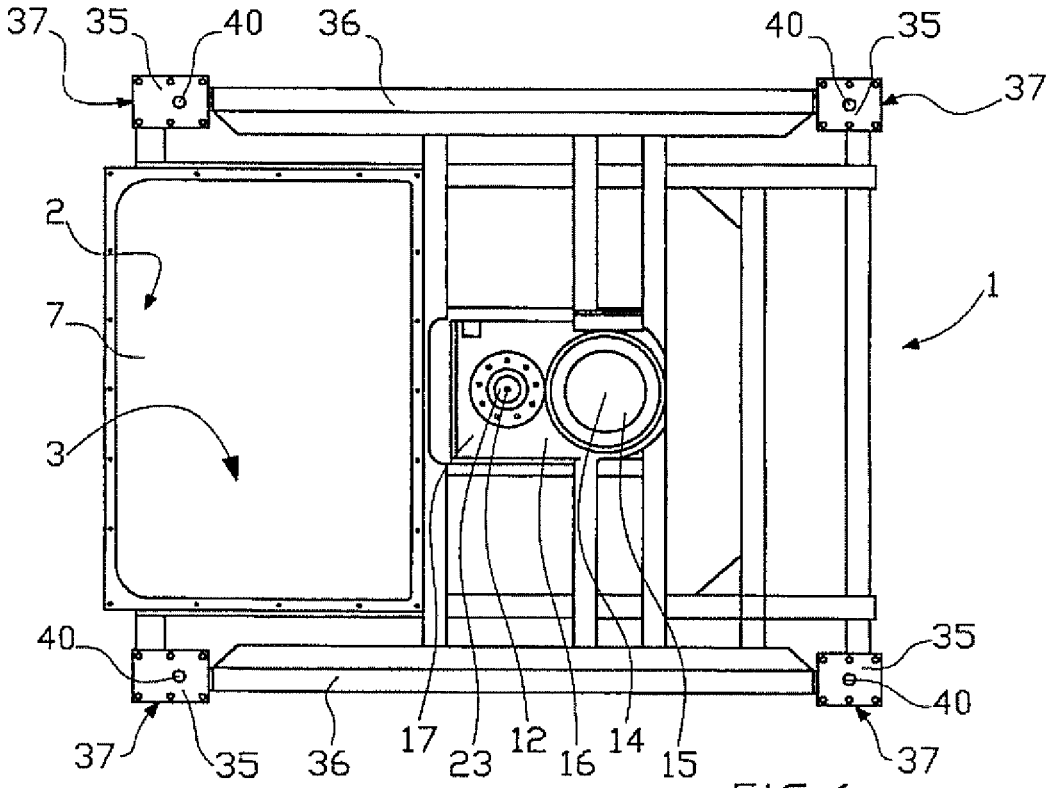
FIG. 6 is a plan view showing the FIG. 1 device and illustrating in particular the arrangement of the FIG. 3 return means within said FIG. 1 device.

The guide support 17 is preferably secured to the enclosure 2 by four flexible connections 35 arranged in a rectangle in a horizontal plane, as shown in FIGS. 1 to 4 and 6. The guide support 17 preferably comprises support means 36, preferably substantially horizontal means, at the ends of which said guide support 17 is connected to the enclosure 2 by the flexible connections 35 (as shown in FIGS. 1, 3, and 6). The flexible connections 35 are attached to the enclosure 2 via support legs 37 preferably four such legs, that extend from the top of the device 1 down to the ground on which it stands, said support legs 37 forming a scaffold that supports the device 1 as a whole.

As shown in FIG. 3, each flexible connection preferably comprises:

- a first damper element 38A such as a rubber damper that is placed under the support beam 36 in question, supporting it in flexible manner, and itself bearing against a first support face 39A of the support leg 37 in order to create a vertical return force causing the guide support to move upwards;
- a second damper element 38B, such as a rubber damper, that is placed above the support beam 36 in question, pressing on the top thereof in flexible manner, and itself pressing against a second support plate 39B of the support leg 37 in order to create a vertical return force causing the guide support to move downwards, the support beam 36 then being vertically built-in in flexible manner between the first and second damper elements 38A and 38B; and
- a third damper element 38C, such as a rubber damper, that is placed on one side of the support beam 36 in question bearing laterally against it in flexible manner, and itself bearing laterally against the support leg 37 so as to create a horizontal return force causing the guide support to move laterally, the support beam 36 then being built-in laterally in flexible manner, firstly at a first end by the third damper element 38C of a first of the four flexible connections 35, and secondly at a second end by the third damper element 38C of a second of the four flexible connections 35.

The degree of flexibility of each flexible connection 35 may preferably be adjusted using adjustment means 40 of the presser screw type (as shown in FIG. 3), so as to adjust the magnitude of the return force delivered by the return means 34 and thus the admittance of the device 1, i.e. the extent to which it allows jamming elements to go through the enclosure 2 without being ground by the shredder tool.

Advantageously, the flexible connections 35 are designed to break when a jamming element that is too strong is inserted into the enclosure 2, so that the drive shaft 23 is not damaged.

The drive means 14 preferably comprise a motor 15 secured to the guide support 17. In such a configuration, the motor 15 and the gearbox 16 are caused to follow any movements of the shredder tool 10, thereby simplifying the design of the drive means 14 and improving the robustness of the device 1.

In preferred manner, the relative position between the shredder tool 10 and the enclosure 2 is adjustable using length variation means 41 for varying the length of said shredder tool 10, as shown in particular in FIG. 4. The length variation means 41 enable the length of the shredder tool 10 to be varied, e.g. in such a manner as to place the first cone 29 at a desired height within the enclosure 2, and so as to move it towards or away from the shredder wall 25 (which wall includes in particular the first and second friction-backing stages 28 and 33). It is thus possible by using the length variation means 41 to adjust, by way of example:

- the propensity of the shredder channel to allow jamming elements to pass through the enclosure 2 without being ground by the shredder tool; and
- the propensity of the device 1 to open containers C of small size.

Specifically, varying the length of the shredder tool 10 makes it possible to enlarge or reduce the shredder channel, respectively so as to facilitate the passage of containers C through the enclosure 2, or to brake such passage.

The shredder wall 25 (which wall includes in particular the first and second friction-backing stages 28 and 33) may preferably be adjusted in height relative to the shredder tool 10, e.g. from the outside of the device 1 so as to adjust the admittance of the shredder channel, e.g. as a function of the size and the solidity of the containers C that are to be opened.

The outlet 4 preferably presents a section of area that is adjustable, the enclosure 2 having a series of longitudinally-extending pivotally-mounted flaps 42 designed to be capable of moving gradually between a spaced-apart configuration and a bunched-together configuration in order to vary the section area of said outlet 4, as shown in FIGS. 1 and 2. Preferably, the top of each pivotal flap 42 is pivotally connected to the enclosure 2 so that the bottom of the shredder wall 25 is of variable perimeter, e.g. so as to vary the conical shape of the shredder wall 25 until it has the shape of an annular skirt. Adjusting the pivotal flaps 42 makes it possible to adjust the admittance of the shredder channel, e.g. as a function of the size and the solidity of the containers C that are to be opened, it being understood that the spaced-apart configuration corresponds to admittance that is greater than the bunched-together configuration.

The pivotal flaps 42 are preferably designed to be adjusted in an adjustment configuration corresponding either to the bunched-together configuration, or to an intermediate configuration between the spaced-apart configuration and the bunched-together configuration, the pivotal flaps 42 being designed to take up the adjustment configuration naturally in the absence of any containers C in the enclosure 2, and being capable of moving away from the adjustment configuration towards the spaced-apart configuration during the passage of containers C through said enclosure 2, said pivotal flaps 42 naturally tending to return towards their adjustment configuration. For this purpose, the pivotal flaps 42 may be surrounded by surrounding springs. The pivotal flaps 42 are thus preferably designed to cause the section of the shredder channel to vary automatically under the action of the containers C, in particular for the purpose of reducing any risk of jamming, while also enabling most or even all containers C to be opened effectively.

The above-described device 1 preferably operates as follows:

- A plurality of containers C for opening are inserted via the inlet 3 of the device 1, e.g. using the inlet conveyor 5, the containers C being full or partially filled with materials M of household refuse type.
- The containers C then drop under gravity through the hopper 7 at the inlet 3 so as to reach the annular shredder channel. The containers C are likely to strike the side wall 8 of the enclosure 2, which may already contribute to opening them, at least in part. The containers C's dropping causes them to acquire speed before they come into contact with the shredder tool 10.
- The containers C then come into contact with the rotating shredder tool 10 so as to be opened thereby. In particular, the shredder tool 10 catches the containers C by means of its shredder knives 13, thereby contributing to opening said containers C by lacerating them. The containers C caught by the shredder tool 10 are also thrown outwards by the centrifugal force generated by the rotation of said shredder tool 10, and thus come into contact with the shredder wall 25 having friction-backing teeth that also contribute to slicing the containers C in order to open them. Containers C of large size become jammed in contact both with the shredder wall 25 and with the shredder tool 10, and they are torn by friction or by traction. Containers C of high mechanical strength exert a force against the shredder tool 10 and/or against the shredder wall 25, so as to make themselves a path towards the outlet 4 by moving said shredder tool 10 away from its reference position, and/or by moving the shredder wall 25 and in particular one or more of its pivotal flaps 42 away from their reference positions.
- The materials M released from the containers C as the containers travel through the enclosure 2 fall under gravity towards the outlet 4 where they are discharged, e.g. by the outlet conveyor 6.

The invention also provides a method of opening containers C, which method is preferably performed using the above-described device 1.

The invention also provides a method of opening containers C containing heterogeneous materials M, of the household refuse kind, in order to enable said materials M to be released from the containers C, the method comprising the following steps:

- introducing said containers C into an enclosure 2 provided with an inlet 3 for admitting containers C and an outlet 4 for released materials M, the inlet 3 being above the outlet 4, so that the containers C travel through the enclosure 2 with the help of gravity; and
- causing the containers C traveling through the enclosure 2 to be opened by putting them into contact with a shredder tool 10 mounted to rotate about an axis of rotation X-X' within the enclosure 2, said shredder tool 10 extending along the axis of rotation X-X' between a bottom end 11 and a top end 12 of said shredder tool 10.

In the method of the invention, the containers C are opened using said shredder tool 10, which is mounted to rotate on a guide support 17 via its top end 12, the bottom end 11 of said shredder tool 10 being free inside said enclosure 2 so as to leave a peripheral space around said shredder tool 10 through which the containers C can pass.

The peripheral space for passing containers C is provided at the periphery of the shredder tool 10, which is suspended in the core of the enclosure 2, e.g. like a pendulum. Such a design serves in particular to ensure that any stringy or filamentary elements, which may be present in the containers C or the materials M, can wind or wrap around the shredder tool 10 to a limited extent only, such that said shredder tool 10 advantageously presents little probability of being braked in its rotation by stringy or filamentary elements. If stringy or filamentary elements do indeed accumulate on the shredder tool 10, such a design also makes it possible to clean the tool by causing said accumulated elements to pass via the bottom end 11 of said shredder tool 10, which bottom end is free, so as to enable said elements to be easily separated from said shredder tool 10. Such cleaning may advantageously be performed while the device 1 is stopped, e.g. by using an inspection hatch 9, as shown in FIG. 2.

The enclosure 2 and the shredder tool 10 preferably form a preferably annular shredder channel through which the containers C are caused to pass in order to open them. The peripheral space advantageously forms said shredder channel. Thus, the peripheral passage space, i.e. the shredder channel, is preferably arranged at the periphery of the shredder tool 10 and is surrounded by the shredder wall 25, that forms part of the side wall 8 of the enclosure 2, and against which the containers C can be thrown by said shredder tool 10 in order to cause them to be opened. The containers C can also be opened by friction when they are of a size that is sufficient for them to come into contact simultaneously with the shredder wall 25 and with the shredder tool 10, so as to be stressed between them. In order to cause the containers C to be opened by friction, the shredder tool 10 and/or the shredder wall 25 are designed to retain the containers C individually by gripping them.

The containers C are preferably introduced into the enclosure 2 in substantially continuous manner or in batches of containers C, so as to form a continuous or discontinuous stream of containers C, thereby enabling the containers C to be opened in industrial manner, e.g. within a waste reprocessing factory or a recycling center.

The method preferably includes a step of automatically increasing the area of the annular section of the shredder channel when the size of the materials M traveling through said shredder channel increases, and of automatically reducing the area of the annular section of the shredder channel when the size of the materials M flowing through said shredder channel decreases. This technical characteristic of the method could constitute an invention on its own that is not necessarily associated with the shredder tool 10 being mounted to rotate on the guide support 17 by its top end 12.

Thus, the method preferably includes a step during which the size of the shredder channel adjusts itself without intervention from a user as a function of the containers C passing through it. This enables the opening method to adapt to a very heterogeneous range of containers C, e.g. containers of sizes, shapes, or mechanical strengths that differ. In other words, the shredder channel presents a through section for the containers C that is automatically adjustable as a function of the nature and the physical properties of said containers C. The method of the invention is thus adapted to opening containers C comprising not only stringy materials M, but also materials of large size, small size, and considerable or little mechanical strength, insofar as each of these types of material is preferably not in a position to interrupt the method by jamming, blocking, or winding in the shredder space, on the shredder tool 10, or on the shredder wall 25.

The method of the invention is thus particularly adapted to opening containers (C) formed by bags made of plastics material or of paper, and containing materials (M) constituting waste, and/or household refuse that is to be subjected to waste processing or recycling.

The increase or the reduction in the area of the annular section of the shredder channel takes place automatically, e.g. when jamming elements (as defined above) pass through, by using any available means, and preferably by using the following together or singly:

a shredder tool 10 movable relative to its reference position under the action of return means 34, the return means being formed by way of example by flexible connections 35 connecting the guide support 17 to the enclosure 2, thereby leading, in more general manner, to the shredder tool 10 having the ability to move away from its reference position under the action of said containers C, where necessary; and/or pivotal flaps 42 designed to move gradually between a spaced-apart configuration and a bunched-together configuration so as to vary the area of the section of said outlet 4 so that the shredder wall 25 is extensible, if necessary, under the action of the containers C passing through the enclosure 2.

SUSCEPTIBILITY OF INDUSTRIAL APPLICATION

The invention finds its industrial application in the design, manufacture, and implementation of means for opening containers containing heterogeneous materials, such as household refuse.

The invention claimed is:

1. A method of opening containers (C) containing heterogeneous materials (M) of a household refuse in order to release said heterogeneous materials (M) from the containers (C), the method comprising the following steps:

introducing said containers (C) into an enclosure (2) having an inlet (3) for admitting the containers (C) and an outlet (4) for the released heterogeneous materials (M), the inlet (3) being disposed above the outlet (4); and opening the containers (C) by causing the containers (C) (i) to travel through a shredder channel, formed in a peripheral space between a shredder tool (10) and a shredder wall (25) included in the enclosure (2), the shredder wall (25) surrounding the shredder tool (10) at a distance, and (ii) to make contact with the shredder tool (10) and the shredder wall (25), the shredder tool (10) being mounted to rotate about an axis of rotation (X-X') within the enclosure (2) and extending along the axis of rotation (X-X') between a bottom end (11) and a top end (12) of said shredder tool (10), the shredder tool (10) being mounted to rotate on a guide support (17) via the top end (12), the bottom end (11) of said shredder tool (10) being free inside said enclosure (2) so as to leave the peripheral space between the shredder tool (10) and the shredder wall (25) for passing the containers (C) around said shredder tool (10), the shredder tool (10), in the absence of said containers (C) in the enclosure (2), being disposed to occupy a reference position, and said shredder tool (10) moving away from the reference position when said containers (C) pass through said enclosure (2) while said shredder tool (10) continues to cause said containers (C) passing through said enclosure (2) to be opened, said shredder tool (10) tending naturally to return to the reference position, and the shredder wall (25) being a deformable wall and deforming when the containers (C) contact the shredder wall (25), thereby enabling the size of said shredder channel to be adjusted as a function of the containers (C) passing therethrough.

2. The method according to claim 1, further comprising:

automatically increasing the area of the annular section of the shredder channel when the size of the materials (M) passing through said shredder channel increases, and automatically reducing the area of the annular section of the shredder channel when the size of the materials (M) passing through said shredder channel decreases.

3. The method according to claim 1, wherein the containers (C) are introduced into the enclosure (2) in a continuous manner or in batches of containers (C), so as to form a continuous or discontinuous stream of containers (C).

4. The method according to claim 2, wherein the containers (C) are introduced into the enclosure (2) in a continuous manner or in batches of containers (C), so as to form a continuous or discontinuous stream of containers (C).

* * * * *